US007174838B2

(12) United States Patent
Sagol et al.

(10) Patent No.: US 7,174,838 B2
(45) Date of Patent: Feb. 13, 2007

(54) COLLAPSIBLE TABLE

(75) Inventors: Sami Sagol, Ramat Hasharon (IL); Efraim Haimoff, Mevasereth Zion (IL)

(73) Assignee: Keter Plastic Ltd., Herzelyia (IL)

( * ) Notice: Subject to any disclaimer, the term of this patent is extended or adjusted under 35 U.S.C. 154(b) by 152 days.

(21) Appl. No.: 10/729,366

(22) Filed: Dec. 8, 2003

(65) Prior Publication Data

US 2005/0120923 A1 Jun. 9, 2005

(51) Int. Cl.
*A47B 3/00* (2006.01)

(52) U.S. Cl. ..... 108/169; 108/130

(58) Field of Classification Search ..... 108/14, 108/162, 166, 167, 168, 169, 171, 172, 174, 108/125, 126, 129, 130, 131, 132, 115; 248/188, 248/188.6, 188.1, 439, 169, 291.1
See application file for complete search history.

(56) References Cited

U.S. PATENT DOCUMENTS

| | | | | | |
|---|---|---|---|---|---|
| 317,097 | A * | 5/1885 | Danner | 108/132 |
| 1,298,249 | A * | 3/1919 | Nichol | 108/132 |
| 1,519,543 | A * | 12/1924 | Kubinyi | 108/132 |
| 1,662,121 | A * | 3/1928 | Moncrieff | 108/167 |
| 1,747,691 | A * | 2/1930 | Bellows | 108/129 |
| 1,923,281 | A * | 8/1933 | Smith | 108/131 |
| 2,026,995 | A * | 1/1936 | Myers | 108/126 |
| 2,760,837 | A * | 8/1956 | Wade | 108/36 |
| 4,318,353 | A * | 3/1982 | Schier | 108/132 |
| 5,009,170 | A * | 4/1991 | Spehar | 108/36 |
| 5,357,872 | A | 10/1994 | Wilmore | |
| 5,551,100 | A * | 9/1996 | Kindrick | 4/578.1 |
| 6,058,853 | A | 5/2000 | Pinch | |
| 6,065,251 | A * | 5/2000 | Kindrick | 52/36.4 |
| 6,112,674 | A | 9/2000 | Stanford | |
| 6,752,091 | B2 * | 6/2004 | Glover et al. | 108/168 |

FOREIGN PATENT DOCUMENTS

| | | |
|---|---|---|
| FR | 501293 | 4/1920 |
| FR | 738868 | 12/1932 |
| GB | 2298782 | 9/1996 |
| JP | 2001299456 | * 10/2001 |

* cited by examiner

*Primary Examiner*—Janet M. Wilkens
(74) *Attorney, Agent, or Firm*—Lowe Hauptman & Berner LLP

(57) ABSTRACT

A collapsible table includes a table top formed of a pair of pivotable table top half-sections hinged to one another at their adjacent edges along a center-line of the table and displaceable between an open position where the half-sections are coplanar, and a folded position where the half-sections overlap one another. Each half-section has at an undersurface thereof a transverse support member pivotally articulated thereto with a leg associated with each lateral edge of the transverse support member, and a pair of longitudinal support members pivotally articulated to the undersurface. The support members are displaceable between erect and collapsed positions whereby the transverse support member is prohibited from collapsing as long as at least one of the longitudinal support members is erect.

29 Claims, 5 Drawing Sheets

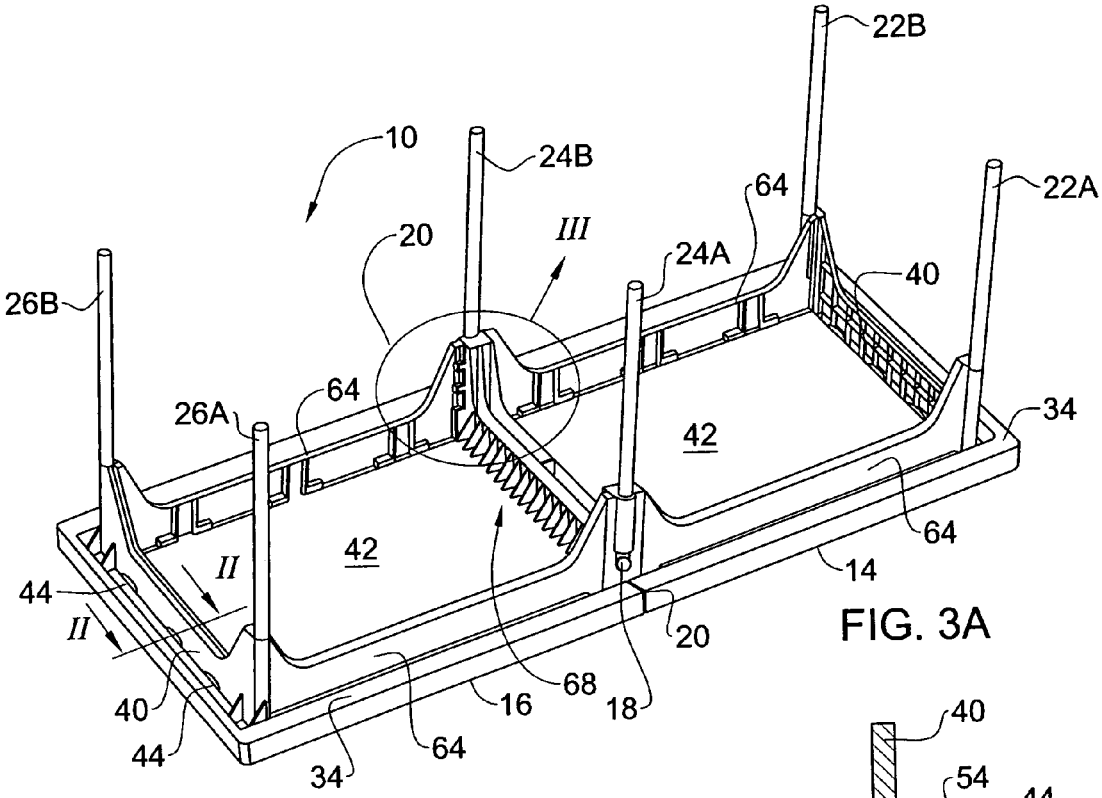
FIG. 3A
FIG. 3B
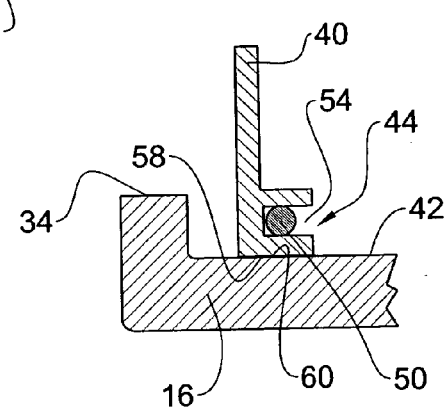
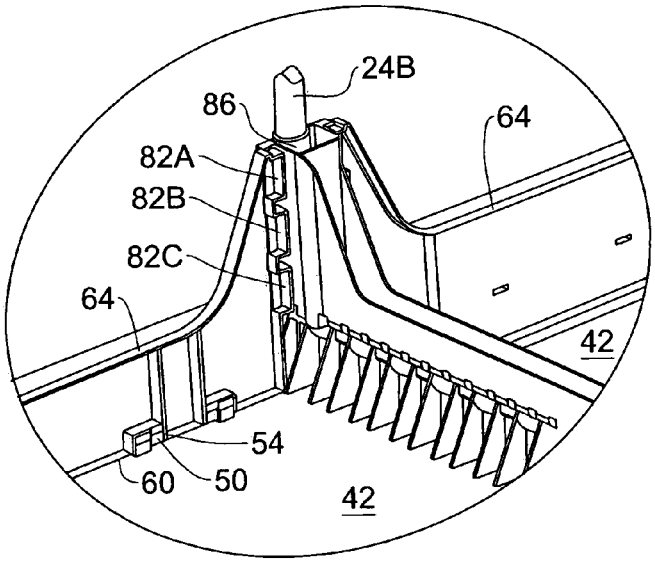
FIG. 3C

COLLAPSIBLE TABLE

FIELD OF THE INVENTION

This invention relates generally to a collapsible table having a table top formed by a pair of hinged half-sections, and more particularly the invention is concerned with such a reinforced collapsible table where at the collapsed position the sections are folded together, receiving between them the legs.

In connection with the present invention the terms collapsible and foldable are used interchangeably.

BACKGROUND OF THE INVENTION AND PRIOR ART

A dining table intended for use only on special occasions, such as for banquets or picnics, must be stored when not in use. Since a dining table occupies a relatively large space, the need to store the table presents a problem, particularly when there are many tables to be stored and the storage facilities are limited. A preferred form of banquet table is therefore one that is collapsible to form a compact structure that occupies relatively little storage space (and optionally could be carried in a car) and that can be easily carried from one place to another.

One type of banquet tables comprises a non-collapsible, rigid and uniform table top, with only the legs being displaceable between an operative state for supporting the table top, and a storage state where the legs are folded against the table top, typically against its bottom surface. Such a table is disclosed, for example, in U.S. Pat. No. 6,112,674.

A typical collapsible table includes a pair of interhinged half-sections to each of which is hingedly attached a leg assembly. To collapse this table its leg assemblies are first folded in against the half-sections of the tabletop, and the half-sections are then folded together to reduce the table to a compact structure requiring little storage space. To erect the table at its site of use, the half-sections are unfolded to form the tabletop and the leg assemblies are folded out to support this tabletop. A collapsible table in this format is disclosed in the U.S. Pat. No. 5,357,872 to Wilmore.

A banquet table may be subjected to heavy loads in the course of its use and accordingly, one of the aspects of the present invention resides in a collapsible banquet table having reinforced half-sections made of plastic material. U.S. Pat. No. 6,058,853 discloses a collapsible banquet table having blow molded plastic half-sections reinforced by rigidified sheets.

However, blow molding is a relatively difficult and costly procedure, and the need to include rigidified reinforcing sheets adds to the cost of producing the half-sections of the table. Consequently the expenses incurred in manufacturing such a collapsible table are substantial and may militate against their sale and use.

It is an object of the present invention to provide a light weight and inexpensive collapsible table having a reinforced structure rendering the table capable of supporting heavy loads which seek to deform the table and whereby bending forces which seek to bend the table along either the longitudinal or transverse axis are resisted.

SUMMARY OF THE INVENTION

According to the present invention there is provided a collapsing table comprising a table top formed of a pair of pivotable table top half-sections hinged to one another at their at their adjacent edges along a center-line of the table and displaceable between an open position where said half-sections are coplanar and a folded position where said half-sections overlap one another; the table characterized in that each section has at an undersurface thereof a transverse support member pivotally articulated thereto with a leg associated with each lateral edge of the transverse support member, and a pair of longitudinal support members pivotally articulated to the undersurface; said support members are displaceable between erect and collapsed positions whereby the transverse support member is prohibited from collapsing as long as at least one of the longitudinal support member is erect. According to a particular embodiment, each lateral end of the transverse support member receives a leg of the table.

To improve stability and load-bearing resistance, there may further be provided a central support member pivotally articulated, along the center-line, at undersurfaces of the top half-sections. Said central support member may comprise one or more table legs.

In order to obtain a firm table structure at its open position, an edge of each longitudinal support member is engageable with a corresponding lateral edge of the transverse support member at the erect position thereof and optionally, adjoining ends of the longitudinal support members and lateral edges of the central support member are engageable at the erect position thereof. According to an embodiment of the invention, the longitudinal support member extends between the central support member and the transverse support member.

Typically, each section is formed at its adjacent edge with a transverse abutment surface, whereby at an open state of the table said abutment surfaces bear against one another.

According to various embodiments and modifications of the present invention, the folding table my have one or more of several features, for example:

- The central support member is pivotally articulated, along the center-line, at undersurfaces of the top half-sections. Optionally, both top half-sections are pivotable about a hinge common also for the central support member.
- At the erect position, the support members have substantial portions extending flush with the undersurface of the respective top half-sections.
- The support members snapingly displace between their collapsed and erect positions.
- All or part of the support members are snappingly engaged with one another at their erect position.
- The support members are pivotally articulated to the undersurfaces by snap-type hinges. For example, the support members are articulated to the half-sections by first hinge segments integrally formed at the undersurfaces and corresponding second hinge segments integrally formed at the support members.
- The half-sections are integrally formed with a peripheral downwardly extending skirt portion.
- At least some of the support members are retainable at the erected position by a snap-type support arrangement.
- A carrying handle or a carrying portion is fitted to either one or both of the top half-sections. According to one particular embodiment, the handle is retractable from between the half-sections at the folded position thereof.

Optionally, a locking arrangement is provided for securing the table at its closed/folded position namely, retaining the half-sections at their folded position, e.g. by a locking latch, by projections formed at one half-section snapingly engageable with corresponding receptacles formed at the opposite half-section, etc.

BRIEF DESCRIPTION OF THE DRAWINGS

In order to understand the invention and to see how it may be carried out in practice, an embodiment will now be described, by way of a non-limiting example only, with reference to the accompanying drawings, in which:

FIG. 3A is a bottom perspective view of the table, at its open position;

FIG. 3B is a section along line II—II in FIG. 3A;

FIG. 3C is an enlargement of the portion marked III in FIG. 3A;

FIGS. 4A to 4E illustrate consecutive steps of collapsing a table according to the present invention, wherein:

FIG. 4A is a bottom perspective view of the table, at a first step of collapsing the table, with a longitudinal support member thereof at an intermediate position;

FIG. 4B is an enlargement of the portion marked IV in FIG. 4A;

FIG. 4C illustrates the table with all its longitudinal support members at the folded position;

FIG. 4D illustrates the table with its transverse support members and their associated legs collapsed; and FIG. 4E illustrates the table at the final collapsing step, with its top surface partially folded.

DETAILED DESCRIPTION OF THE INVENTION

Figure 1:
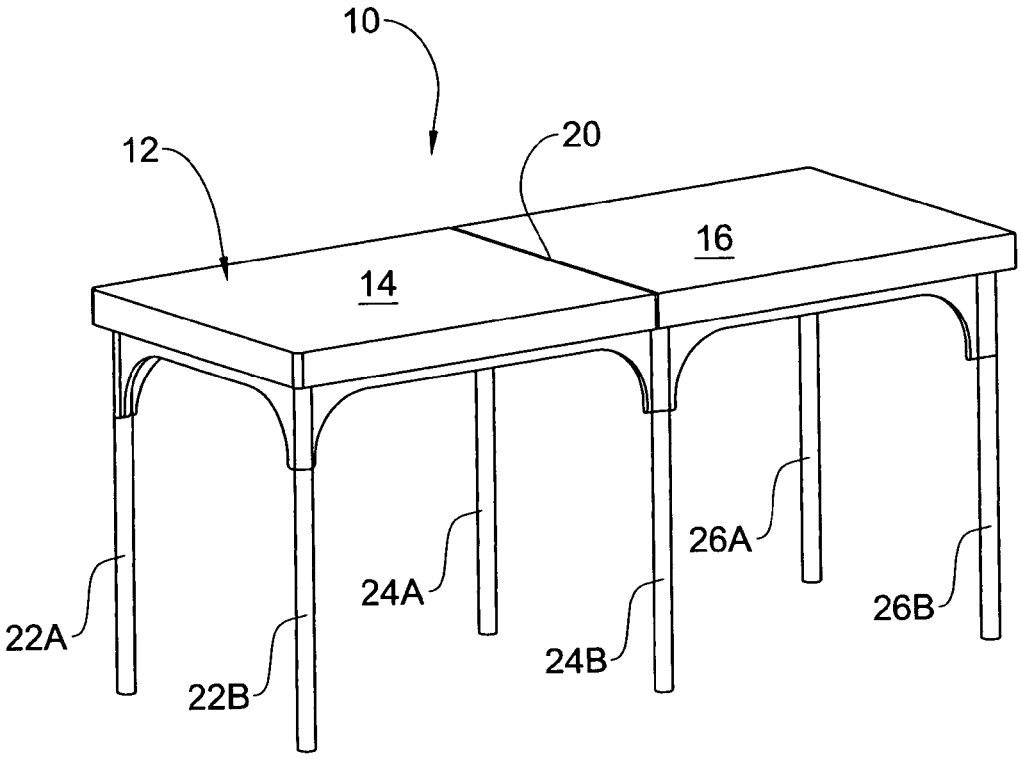
FIG. 1 is top perspective view of a table according to the present invention, at its open position.
Figure 4A:
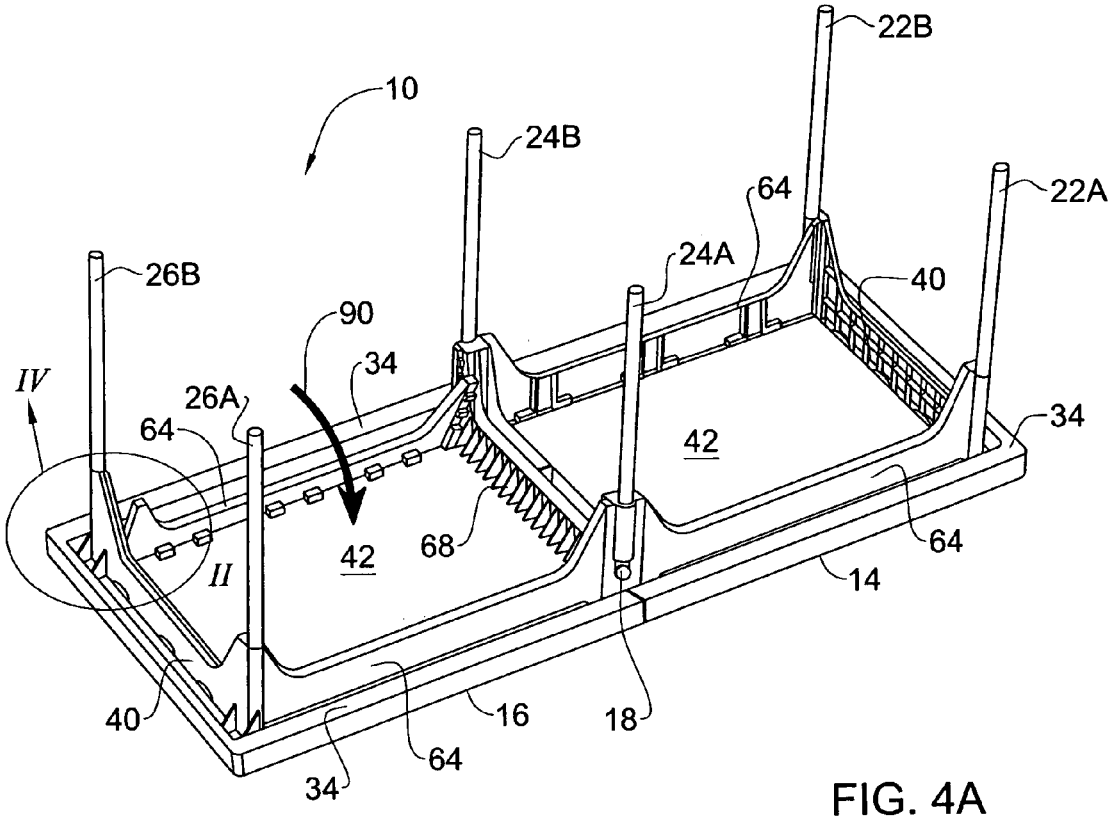

Reference is first made to FIG. 1 illustrating a collapsible table in accordance with the present invention generally designated 10 comprising two pivotable table top half sections 14 and 16 hingedly connected to one another and foldable about a pivot axle 18 (see in FIGS. 3A and 4A), extending transversally at a center line 20 of the table 10. In the open position of FIG. 1 the half sections 14,16 are coplanar.

The table 10 is supported by six legs arranged in pairs and designated 22A and 22B; 24A and 24B; 26A and 26B and will be discussed in more detail hereinafter.

Figure 2:
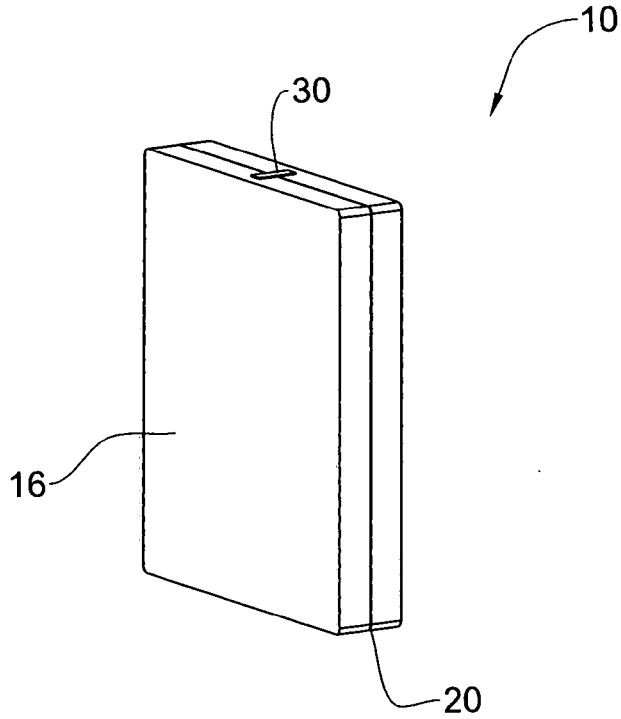
FIG. 2 is a perspective view of the table, at its closed/collapsed position.

The table 10 is foldable/collapsible between an open position as illustrated in FIG. 1 where the table top is supported by the legs, and a closed/folded/collapsed position as illustrated in FIG. 2. Also seen in FIG. 2 is a latch 30 to retain the half sections 14 and 16 in the closed, overlapping position.

In FIG. 3A the table 10 is illustrated from its bottom side and as can be seen at each of the half sections 14 and 16, in the present case made of plastic material, is formed with a peripheral skirt portion 34, increasing the rigidity and load bearing ability of the table 10, and further, providing space for accommodating the legs and the support members, in the closed position, as will become apparent hereinafter.

It is further noticed in FIG. 3A that the ends of legs 22A and B and 26A and B are attached to a transversed support member 40 pivotably articulated to an under surface 42 of the half sections 14 and 16 by means of hinge portions 44.

The arrangement is such that the under surface 42 of the half sections 14 and 16 comprises several hinge segments 50 (see FIG. 3B) integrally formed therewith and adapted for snap-type engagement with a receptacle hinge cavity 54 integrally formed with the transverse support member 40. The hinge segments 50 are sized and shaped such that the transverse support members 40 are snappingly displaceable in a toggle type manner between an erect position (FIGS. 3A and 3B) and a collapsed position (FIG. 4D) and further such that in the erect position a surface 58 of the support member 40 flushingly bears against a corresponding surface 60 at the under surface 42.

Further noticed in FIG. 3A there are provided four longitudinal support members 64, each extending along a corresponding edge of the respective half section. The longitudinal support members 64 are pivotably articulated to the under surfaces 42 of the half sections 14 and 16, in the same manner as disclosed hereinabove in connection with the transverse support members 40, with particular reference to FIG. 3B.

A central support member 68 is mounted on the common pivot axle 18 pivotably attaching the half sections 14 and 16 whereby at the open position of the table 10, when the two half sections are coplanar, the central support member bears against corresponding portions at the undersurface 42 of the half sections, to thereby provide increased load bearing and stability of the table. Legs 24A and 24B extend from the central support member 68. In accordance with other particular embodiments (not illustrated) the central support member 68 may be omitted entirely or may be designed to have one central leg or no legs at all.

As can best be seen in FIG. 3A, at the open position of the table 10, all of the support members 40 and 64 stand erect and perpendicular to the undersurface 42; the transverse support members 40 and the central support member 68 extend parallel to the pivot axle 18; and the longitudinal support members 64 extend at right angles thereto.

Figure 4B:
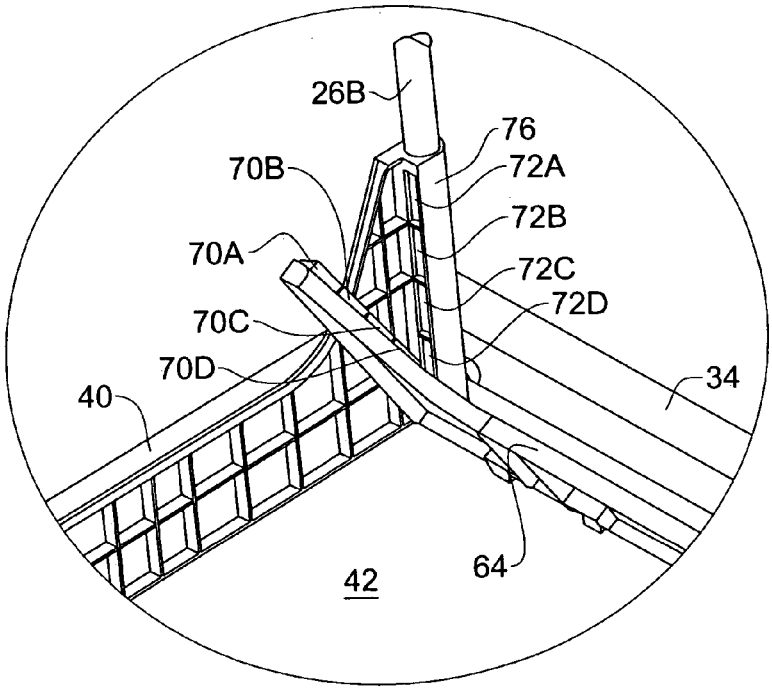

In this position when all of the support members 40 and 64 are erect, a closed box-like support structure is formed by them and each support member engages at its respective ends corresponding ends of a mating support member by means of a snap-type engagement as will be described in more detail with reference to FIGS. 3C and 4B. The construction of the box/frame like structure gives rise to a table of improved rigidity and load bearing ability in both the longitudinal and transverse directions.

The support members 40 and 64 are retained in their erect position, in accordance with an embodiment of the present invention, both by the toggle-type hinge arrangement of the support members to the under surface 42 of the half sections 14 and 16 and by the snap-type engagement between adjoining ends of respective support members. An example of such an engagement arrangement is seen in FIG. 4B, which is an enlargement of the portion marked IV in FIG. 4A, where the longitudinal support member 64 comprises four lateral projections 70A, 70B, 70C and 70D designed for snap-engagement within corresponding receptacles designated 72A, 72B, 72C and 72D, respectively, formed at a leg support portion 76 receiving leg 26B of the transverse support member 40.

Thus, displacement of a longitudinal support member from its erect position to its collapsed position requires some force thereby to prevent unintentional displacement thereof.

FIG. 3C is an enlargement of the portion marked III in FIG. 3A whereby an end portion of the lateral support member 64 is formed with three projections 82A, 82B and 82C designed for snap-engagement within corresponding receptacles (not seen in this position) formed in leg receptacle 86 supporting leg 24B of the central support member 68.

This arrangement also requires application of some reasonable force to thereby prevent unintentional collapsing of the longitudinal support members 64.

With further reference made to FIGS. 4A to 4E, it will now be explained how the table 10 is collapsed/folded from its open position as illustrated in FIGS. 1 and 3A to its closed/folded position as in FIG. 2.

Figure 4C:
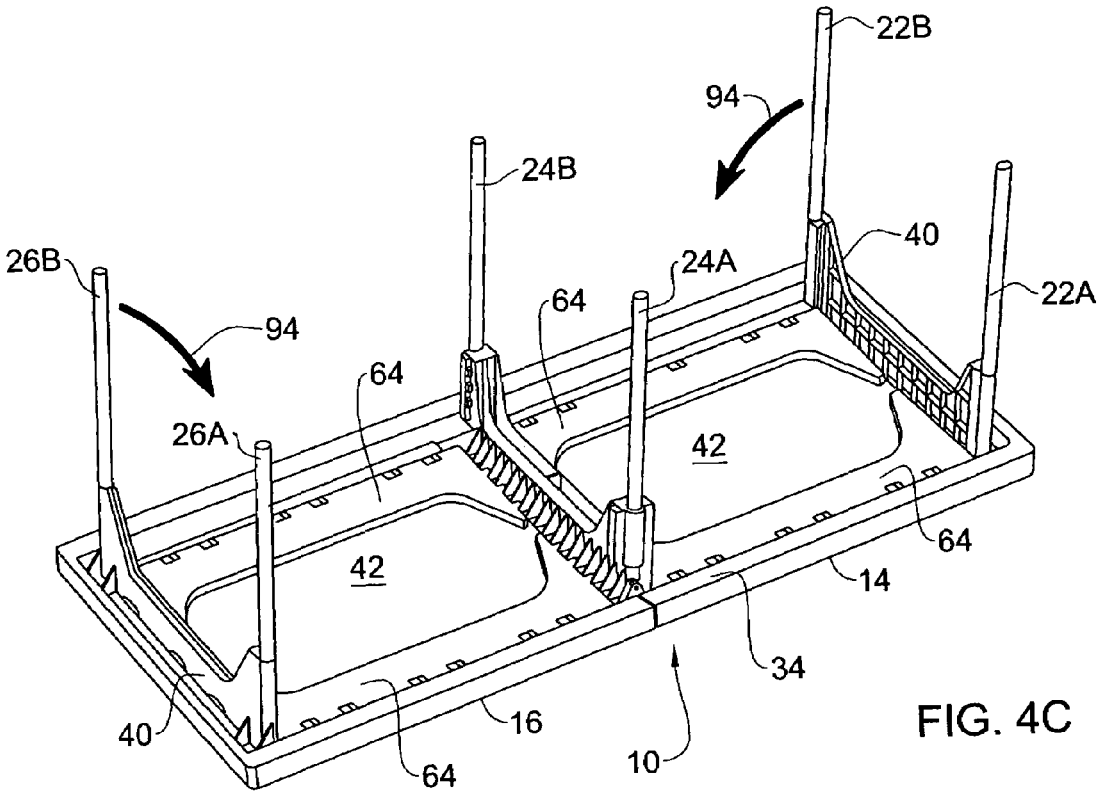
Figure 4D:
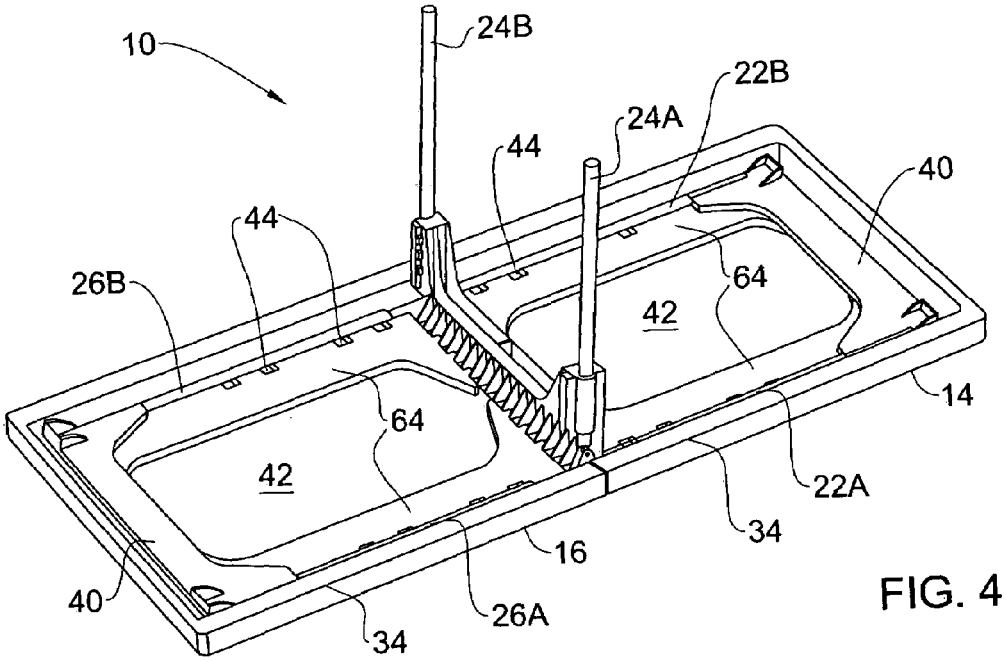

At a first step (FIG. 4A) the four longitudinal support members 64 are collapsed by pivotally displacing them inwardly in the direction of arrow 90. FIG. 4C illustrates the table 10 after the four longitudinal support members 64 have been collapsed and lie flush against the under surface 42 of the half sections 14 and 16 (FIG. 4C).

Only at this point, after the longitudinal support members 64 of each half section 14 and 16 have been collapsed, the transverse support members 40 may be collapsed by turning them inward as indicated by arrows 94 in FIG. 4C such that the transverse support members 40 lie over the already folded longitudinal support members 64. It is noticed that in the position shown in FIG. 4D the collapsed transverse support members 40 and their respective legs 22A, 22B and 26A, 26B do not occupy the entire space formed by the peripheral skirt 34, thereby allowing sufficient space to accommodate the central support member 68 and the central legs 24A and 24B.

At a final step the half sections 14 and 16 are pivotally displaced towards one another (arrow 98 in FIG. 4E) until obtaining the fully closed position as in FIG. 2.

Figure 4E:
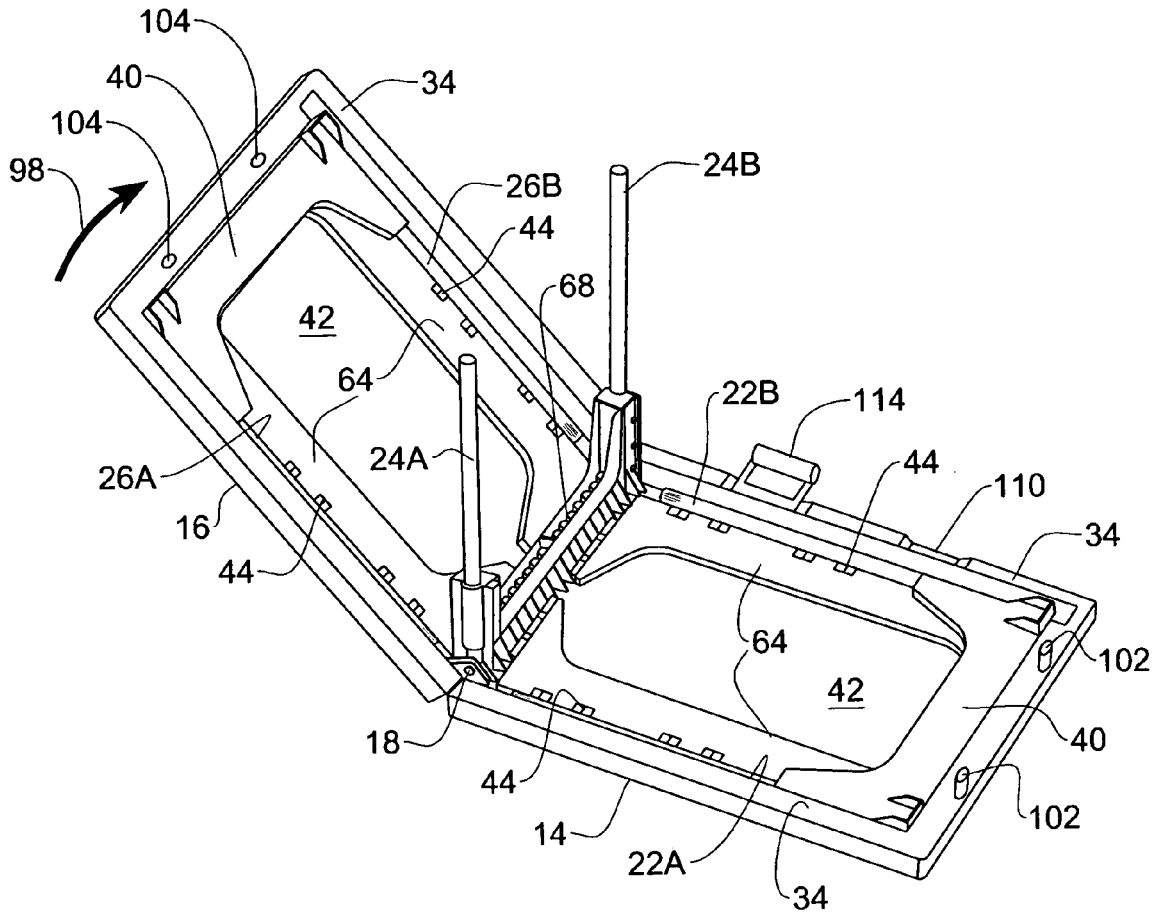

Retaining the table 10 in its closed position, may be obtained by closing latch 30 (FIG. 2) or by snap type arrangement as illustrated for example in FIG. 4E wherein the skirt portion 34 of the half section 14 comprises two projections 102 fitted for snap engagement within corresponding two receptacles 104 fitted on the skirt 34 of half section 16.

Finally, carrying the table 10 from one place to another may be facilitated by a handle 110 formed at half sections 14 by means of a depression at the skirt portion 34 enabling one to insert his hand between the half section when the table is in its closed position. In accordance with a variation thereof, such a depression may be formed also at the half section 16 and optionally also at the opposed sides thereof. As an alternative, there may be provided a handle 114 (FIG. 4E) displaceable between an extracted position as shown, and a retracted position (not shown) merely by folding or sliding it about a suitable hinge or rack.

While there has been shown an embodiment with several modifications of the invention, it will be appreciated by a person of the art that many changes may be made therein without departing from the spirit and the scope of the invention, mutatis mutandis.

The invention claimed is:

1. A collapsible table, comprising:

a table top comprising a pair of pivotable table top half-sections which are hinged to one another at their adjacent edges along a center-line of the table and are displaceable between an open position where said half-sections are coplanar and a folded position where said half-sections overlap one another;

wherein each of said half-sections is provided at an undersurface thereof with a transverse support member and with a pair of longitudinal support members, and each of said transverse support member and said longitudinal support members is pivotally displaceable with respect to the undersurface of the corresponding half-section between an erect position and a collapsed position, whereby displacement of the transverse support member from the erect position to the collapsed position is prevented as long as at least one of the longitudinal support members is in the erect position;

wherein each of the transverse support members is snappingly engageable with the respective longitudinal support members when said respective transverse and longitudinal support members are in the erect position.

2. A collapsible table according to claim 1, further comprising a pivot axle to which said half-sections are pivotally connected, and a central support member mounted on said axle.

3. A collapsible table according to claim 2, further comprising at least one leg attached to the central support member.

4. A collapsible table according to claim 3, wherein said at least one leg is attached to each of lateral ends of the central support member.

5. A collapsible table according to claim 2, wherein adjoining ends of the longitudinal support members being in the erect position are engageable with lateral edges of the central support member.

6. A collapsible table according to claim 2, wherein an edge of each of the longitudinal support members being in the erect position is engageable with a corresponding lateral edge of the central support member.

7. A collapsible table according to claim 2, wherein the central support member is hingedly coupled to said pivot axle extending along the centerline of the table.

8. A collapsible table according to claim 2, wherein said half-sections are pivotable about said pivot axle, which is common also for the central support member.

9. A collapsible table according to claim 2, wherein the longitudinal support members extend perpendicularly to the central support member and the transverse support members.

10. A collapsible table according to claim 1, wherein the transverse support member of each of the half-sections extends adjacent an end of the half-section.

11. A collapsible table according to claim 1, wherein the transverse support member of each of the half-sections extends parallel to the centerline of the table.

12. A collapsible table according to claim 1, further comprising legs attached to lateral ends of the transverse support member of each of the half-sections.

13. A collapsible table according to claim 1, wherein an edge of each of the longitudinal support members being in the erect position is engageable with a corresponding lateral edge of the respective transverse support member being in the erect position.

14. A collapsible table according to claim 1, wherein each said half-section is formed, at its edge adjacent the other half-section, with a transverse abutment surface, and in the open position of the table, said transverse abutment surface of one said half-section bears against the transverse abutment surface of the other half-section.

15. A collapsible table according to claim 1, wherein the longitudinal support members are directed essentially along the length of the half-sections.

16. A collapsible table according to claim 1, wherein the longitudinal support members comprise several members linked together.

17. A collapsible table according to claim 1, wherein the transverse and longitudinal support members are pivotally articulated to the undersurfaces of the corresponding half-sections by snap-type hinges.

18. A collapsible table according to claim 17, wherein said hinges comprise first hinge segments integrally formed at the undersurfaces and corresponding second hinge segments integrally formed at the transverse and longitudinal support members.

19. A collapsible table according to claim 1, wherein the half-sections are integrally formed with a peripheral downwardly extending skirt portion.

20. A collapsible table according to claim 1, wherein at least one of the transverse and longitudinal support members is retainable in the erected position by a snap-type support arrangement.

21. A collapsible table according to claim 1, wherein, in the erect position, the transverse and longitudinal support members have portions which are substantially flush with the undersurfaces of the respective table top half-sections.

22. A collapsible table according to claim 1, wherein the half-sections and the transverse and longitudinal support members are made of plastic material.

23. A collapsible table according to claim 1, further comprising a carrying handle which is fitted to either one or both of the table top half-sections.

24. A collapsible table according to claim 23, wherein the handle is extractable from between the half-sections being in the folded position.

25. A collapsible table according to claim 23, wherein the handle is a recess integrally formed at least one of the table top half-sections.

26. A collapsible table according to claim 1, further comprising a lock arrangement for securing the half-sections in the folded position.

27. A collapsible table according to claim 1, wherein, in the erect position, the transverse support members engage the respective longitudinal support members to form a closed frame supporting the table top.

28. A collapsible table, comprising:

a table top comprising a pair of table top half-sections which are (i) pivotably hinged to one another at their adjacent edges along a center-line of the table, and (ii) pivotally displaceable between an open position where said first and second half-sections are coplanar and a folded position where said first and second half-sections overlap one another;

for each of said half-sections, a pair of longitudinal support members and a transverse support member pivotally attached to an undersurface of said half-section so as to be pivotally displaceable between an erect position and a collapsed position, wherein displacement of the transverse support member from the erect position to the collapsed position is prevented by at least one of the longitudinal support members being in the erect position;

at least one leg attached to and pivotable together with the transverse support member of each of said half-sections; and a central support member which is pivotally articulated, along the center-line, to the undersurfaces of said half-sections.

29. A collapsible table, comprising:

a table top comprising a pair of table top half-sections which are (i) pivotably hinged to one another at their adjacent edges along a center-line of the table, and (ii) pivotally displaceable between an open position where said first and second half-sections are coplanar and a folded position where said first and second half-sections overlap one another;

for each of said half-sections, a pair of longitudinal support members and a transverse support member pivotally attached to an undersurface of said half-section so as to be pivotally displaceable between an erect position and a collapsed position, wherein displacement of the transverse support member from the erect position to the collapsed position is prevented by at least one of the longitudinal support members being in the erect position; and at least one leg attached to and pivotable together with the transverse support member of each of said half-sections;

wherein the transverse support member of each of the half-sections extends parallel to the center-line of the table.

* * * * *